US007295213B2

(12) United States Patent
Kim et al.

(10) Patent No.: US 7,295,213 B2
(45) Date of Patent: Nov. 13, 2007

(54) APPARATUS AND METHOD FOR CONVERTING METADATA COLOR TEMPERATURE AND APPARATUS AND METHOD FOR PROVIDING METADATA

(75) Inventors: Sang-kyun Kim, Kyungi-do (KR); Du-sik Park, Kyungi-do (KR); Chang-yeong Kim, Kyungi-do (KR); Ki-won Yoo, Seoul (KR); Young-sik Huh, Kyungki-do (KR)

(73) Assignee: Samsung Electronics Co., Ltd., Suwon, Kyungki-do (KR)

( * ) Notice: Subject to any disclaimer, the term of this patent is extended or adjusted under 35 U.S.C. 154(b) by 88 days.

(21) Appl. No.: 10/341,510

(22) Filed: Jan. 14, 2003

(65) Prior Publication Data

US 2003/0210250 A1 Nov. 13, 2003

(30) Foreign Application Priority Data

May 10, 2002 (KR) ..... 2002-25910

(51) Int. Cl.
*G09G 5/02* (2006.01)

(52) U.S. Cl. ..... 345/589; 345/591; 345/600; 348/223.1; 348/655

(58) Field of Classification Search ..... 345/589, 345/600, 426, 581, 591, 593–594; 382/167; 358/1.9, 578, 521; 348/223.1; 707/1, 100, 707/104.1

See application file for complete search history.

(56) References Cited

U.S. PATENT DOCUMENTS 5,262,848 A * 11/1993 Kim ..... 348/223.1
5,481,302 A * 1/1996 Yamamoto et al. ..... 348/223.1
5,541,649 A * 7/1996 Yamamoto et al. ..... 348/223.1
5,874,955 A * 2/1999 Rogowitz et al. ..... 345/589
6,249,601 B1 6/2001 Kim et al.
6,629,104 B1 * 9/2003 Parulski et al. ..... 707/102

(Continued)

FOREIGN PATENT DOCUMENTS

EP 1 276 057 A2 1/2003

(Continued)

OTHER PUBLICATIONS

"Working with raw image files in Adobe Photoshop," http://www.adobe.com/products/photoshop/pdfs/ps_cameraraw_userguide.pdf.*

(Continued)

*Primary Examiner*—Kee M. Tung
*Assistant Examiner*—Antonio A Caschera
(74) *Attorney, Agent, or Firm*—Buchanan Ingersoll & Rooney PC

(57) ABSTRACT

A method and an apparatus for converting the color temperature of metadata and a method and an apparatus for providing image metadata are provided. The apparatus for providing image metadata includes an input unit, an image metadata decoding unit, and an image color temperature converting unit. The input unit receives an input image, metadata corresponding to the color temperature of the input image, and color temperature information preferred by a user. The image metadata decoding unit calculates a color temperature corresponding to the metadata. The image color temperature converting unit converts the color temperature of the input image using the color temperature calculated by the image metadata decoding unit and the color temperature information preferred by a user.

15 Claims, 1 Drawing Sheet

U.S. PATENT DOCUMENTS

| | | | | |
|---|---|---|---|---|
| 6,757,684 | B2 * | 6/2004 | Svendsen et al. | 707/10 |
| 6,833,865 | B1 * | 12/2004 | Fuller et al. | 348/231.2 |
| 2001/0030694 | A1 * | 10/2001 | Abe | 348/223 |
| 2001/0040588 | A1 * | 11/2001 | Shiraiwa et al. | 345/690 |
| 2004/0027624 | A1 * | 2/2004 | Parulski et al. | 358/527 |
| 2005/0050043 | A1 * | 3/2005 | Pyhalammi et al. | 707/6 |

FOREIGN PATENT DOCUMENTS

| | | | |
|---|---|---|---|
| EP | 1 276 057 | A3 | 10/2004 |
| JP | 10-031479 | | 2/1998 |
| JP | 10-224643 | | 8/1998 |
| JP | 10224643 | | 8/1998 |
| JP | 10-340336 | | 12/1998 |
| JP | 10340336 | | 12/1998 |
| JP | 2000-171304 | | 6/2000 |
| KR | 1998-0078328 | | 4/1997 |
| KR | 1998-0079137 | | 11/1998 |
| WO | 96/01467 | | 1/1996 |

OTHER PUBLICATIONS

"Adobe Photoshop for Windows—Downloads", http://www.adobe.com/support/downloads/product.jsp?product=39 &platform=Windows.*

"Adobe Photoshop 7.0.1 update—Photoshop for Macintosh—Downloads," http://www.adobe.com/support/downloads/product.jsp?ftpID=1852.*

"Digging into Adobe Camera Raw—Tutorial," http://studio.adobe.com/us/tips/tip.jsp?p=1&id=650&xml=phs8ppraw.*

NISO Standards Committee, "NISO Draft Standard, Data Dictionary—Technical Metadata or Digital Still Images," Working Draft 1.0, Jul. 5, 2000.*

Digital Imaging Group, Inc., "DIG35 Specification—Metadata for Digital Images," Version 1.0, Aug. 30, 2000, pp. 26-43.* http://en.wikipedia.org/wiki/Color_temperature.*

European Search Report issued by the European Patent Office on Dec. 3, 2004 in corresponding application.

J. M. Corridoni et al., "Image Query by Semantical Color Content," Proceedings of the Workshop on Advanced Visual Interfaces AVI, May 27, 1996, pp. 213-222.

A. Del Bimbo, "A Perspective View on Visual Information Retrieval Systems," Content-Based Access of Image and Video Libraries, 1998, Proceedings, IEEE Workshop on Santa Barbara, CA, Jun. 21, 1998, pp. 108-109.

* cited by examiner

APPARATUS AND METHOD FOR CONVERTING METADATA COLOR TEMPERATURE AND APPARATUS AND METHOD FOR PROVIDING METADATA

BACKGROUND OF THE INVENTION

This application claims the priority of Korean Patent Application No. 2002-25910, filed May 10, 2002, in the Korean Intellectual Property Office, the disclosure of which is incorporated herein in its entirety by reference.

1. Field of the Invention

The present invention relates to a method and an apparatus for controlling the color temperature of displayed images according to a user's preference, and more particularly, to a method and an apparatus for controlling display preference by using color temperature metadata.

2. Description of the Related Art

In conventional techniques, the color temperature of output images provided to a user, i.e., a customer of image contents, has been adjusted by calculating the color temperature of the corresponding images in a user terminal.

However, according to such conventional techniques, it is difficult to reduce the cost of manufacturing user terminals since such user terminals must be manufactured to be able to compute the color temperatures of images. In addition, it is difficult to store the color temperatures of images, which are already computed, in a database as metadata and to re-use the metadata.

SUMMARY OF THE INVENTION

The present invention provides an apparatus and a method for providing metadata corresponding to the color temperatures of an input image.

The present invention also provides an apparatus and a method for converting such metadata into predetermined color temperatures.

According to an aspect of the present invention, there is provided an apparatus for providing image metadata. The apparatus includes a color temperature calculating unit which receives a predetermined image signal and derives color temperature information from the image signal, a metadata generating unit which receives the color temperature information, converts the color temperature information into metadata, and stores the metadata in a database, and an image metadata transmitting unit which transmits the metadata as well as the image signal to a user terminal over a communication network in response to the request of the user terminal.

According to another aspect of the present invention, there is provided an apparatus for converting a metadata color temperature. The apparatus includes an input unit which receives an input image, metadata corresponding to the color temperature of the input image, and color temperature information preferred by a user, an image metadata decoding unit which calculates a color temperature corresponding to the metadata, and an image color temperature converting unit which converts the color temperature of the input image using the color temperature calculated by the image metadata decoding unit and the color temperature information preferred by a user.

Preferably, the apparatus further includes an image display unit which outputs the input image, the color temperature of which is converted, and then provides the input image to a user.

Preferably, the image metadata decoding unit calculates the color temperature of an image coded as metadata and decodes the metadata following the way the image is coded.

Preferably, the image metadata decoding unit includes a predetermined look-up table, in which representative color temperatures of color temperature ranges, which the color temperature belongs to, and their corresponding metadata are recorded, and finds a color temperature value corresponding to certain metadata by searching the metadata in the look-up table.

According to still another aspect of the present invention, there is provided a method for providing image metadata. The method includes receiving a predetermined image signal and finding color temperature information from the image signal, receiving the color temperature information, converting the color temperature information into metadata, and storing the metadata in a database, and transmitting the metadata as well as the image signal to a user terminal over a communication network in response to the request of the user terminal.

According to still another aspect of the present invention, there is provided a method for converting the color temperature of metadata. The method includes receiving a predetermined input image, metadata corresponding to the color temperature of the input image, and color temperature information preferred by a user, calculating the color temperature corresponding to the metadata, and converting the color temperature of the input image using the color temperature calculated based on the metadata and the color temperature information preferred by a user.

Preferably, the method further includes outputting the input image, the color temperature of which is converted, and providing the input image to a user.

BRIEF DESCRIPTION OF THE DRAWINGS

The above features and advantages of the present invention will become more apparent by describing in detail exemplary embodiments thereof with reference to the attached drawing in which.

DETAILED DESCRIPTION OF THE INVENTION

Figure 1:
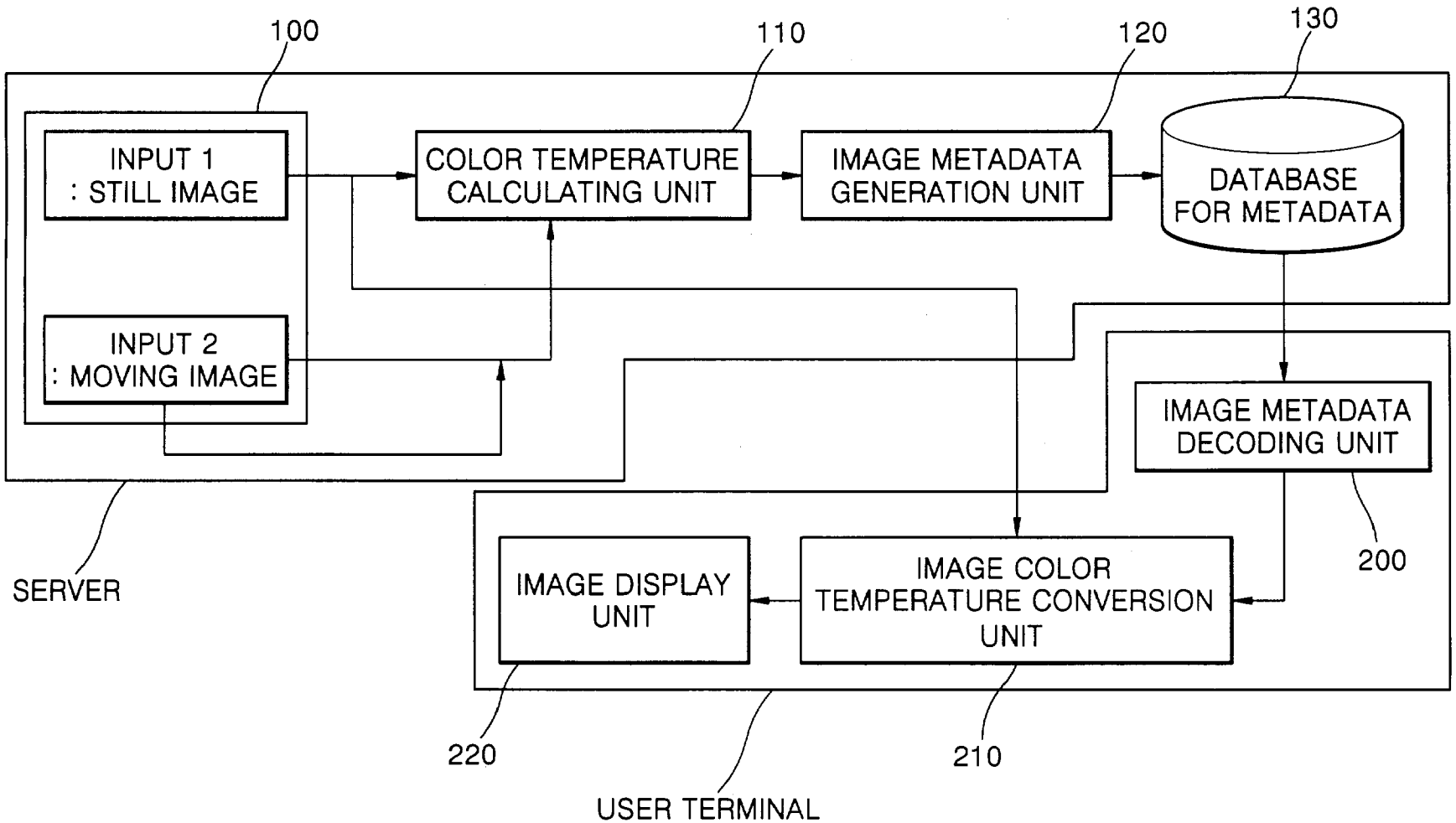
FIG. 1 is a diagram of an apparatus for controlling the display of images according to a user's preference by using color temperature metadata according to the present invention.

Hereinafter, the present invention will be described in greater detail with reference to the accompanying drawing.

FIG. 1 is a diagram of an apparatus for controlling the display of images by using color temperature metadata according to the present invention. Referring to FIG. 1, input images of an image input unit 100 include still images input from an image database and a bunch of still images constituting a moving image. Such still images may refer to representative images of the moving image.

A color temperature calculating unit 110 converts images input from the image input unit into a CIE XYZ color space and approximates the chromaticity coordinates (x, y) of a light source. Next, the color temperature calculating unit 110 converts the chromaticity coordinates (x, y) into correlated color temperatures which will act as descriptors representing images. The method of deriving chromaticity coordinates is disclosed in Japanese Patent No. 10-118862, and Korean Patent Nos. 237284 and 230446.

An image metadata generation unit 120 converts the color temperatures of the input images into metadata. Here, the metadata refers to a simple method of representing images. In other words, metadata corresponding to the input images stored in a database is transmitted to a user. For example, a color temperature of 1,667 K-25,000 K can be represented by 15 bits.

Alternatively, metadata can be generated by the following method. Input images can be sorted according to what a viewer feels about each of the input images, namely, according to the degree to which each of the input images looks warm, by using color temperatures. In other words, the input images can be classified as hot images, warm images, moderate images, or cool images by mapping the degree to which each of the input images looks warm in a certain range of color temperatures. For example, hot images can be mapped in a color temperature range of below 2,250 K, warm images can be mapped in a color temperature range of 2,251 K-4,170 K, moderate images can be mapped in a color temperature range of 4,171 K-8,060 K, and cool images can be mapped in a color temperature range of over 8,060 K. Each of the four image groups can be represented by 2 bits as metadata. For example, hot images, warm images, moderate images, and cool images can be represented by 00, 01, 10, and 11, respectively. The four color temperature ranges are converted into reciprocal color temperature ranges, and the reciprocal color temperature ranges are divided into several equal sub-ranges by quantization. Reciprocal color temperature (RC) can be derived from the following equation using color temperature: $RC=10^6/C$. The reason such a reciprocal color temperature scale is used is that the difference between images in terms of reciprocal color temperature is the same as the difference between the images sensed by human eyes.

After converting the color temperature ranges into the reciprocal color temperature ranges, the reciprocal color temperature ranges are divided by N so that they can be represented by Upper(In(N)) bits. Here, Upper(X) indicates a minimum natural number greater than X. For example, Upper(2.1)=3. In a case where M reciprocal color temperature ranges are divided by N, they can be represented by Upper(In(M))+Upper(In(N)) bits. For example, in a case where there are four color temperature ranges and they are divided by 64, i.e., in a case where M=4 and N=64, the color temperature ranges can be represented by 8 bits because Upper(In(4))+Upper(In(64))=2+6=8.

The database for image metadata is a set of color temperature metadata of still images or a bunch of images constituting a moving image, i.e., representative images of the moving image.

An image metadata decoding unit 200 decodes transmitted image metadata and thus computes the color temperature value of an input image. The method of decoding metadata varies depending on the type of metadata. If metadata represents the color temperature of an input image itself, for example, if a color temperature of 1,667 K-25,000 K is represented by 15 bits, only a process of converting coded binary numbers into decimal numbers is needed. On the other hand, if the color temperature of an input image, which is computed by the color temperature calculating unit 110, is quantized through the metadata generator, the color temperature metadata input into the image metadata decoding unit 200 must be converted into a predetermined color temperature range, and a color temperature representing the predetermined color temperature range must be derived. For example, a color temperature representing a certain color temperature range can be the average of color temperature values in the color temperature range.

A binary number, like 00000001, which is quantized into 8 bits through the color temperature metadata generator, is converted into a corresponding color temperature range, and the representative color temperature of the color temperature range is extracted. This method will be described in detail in the following.

(1) The first two bits of an 8-bit binary number are decoded in order to figure out which color temperature range corresponds to the 8-bit binary number. (For example, 00: hot→[1,667K, 2,250K], $T_{lb}$=1,667, $T_{ub}$=2,250)

(2) The maximum and minimum values in the corresponding color temperature range are converted into a reciprocal megakelvin scale. $RT_{lb}$=106/Tlb and $RT_{ub}$=106/2,250 =444.444)

(3) The corresponding color temperature range [599.88, 444.444] is equally quantized into 64 sub-ranges.

(4) The remaining six bits (for example, 000001 in 00000001→$2^{nd}$sub-range) of the 8-bit binary number are decoded and their corresponding color temperature range (for example, [597.0149, 595.0227]) is figured out, thus calculating an average color temperature ((597.0149+595.0227)÷2=596.0188). Next, the average color temperature is determined as a representative color temperature of the corresponding color temperature range and a color temperature corresponding to the 8-bits. (For example, $10^6$/596.0188=1,678 K)

Alternatively, a table of color temperatures corresponding to metadata is formed in advance following the above mentioned processes (1) through (4). The image metadata decoding unit 200 can be constituted so that a color temperature corresponding to certain 8-bit metadata can be found in the table by using the metadata as an address like in a look-up table method. In this case, even though a space where such table data need to be stored, is necessary, it is possible to extract a representative color temperature fast without using hardware for computation.

An image color temperature conversion unit 210 calculates a target color temperature based on an input image, the color temperature of the input image, and a color temperature preferred by a user. Next, the image color temperature conversion unit 210 modifies the input image using the target color temperature and the color temperature preferred by the user.

An image display unit 220 displays the modified image to the user.

The above-mentioned embodiments of the present invention can be written as programs that can be performed in a computer and can be realized in a commonly-used digital computer which operates such programs using a computer-readable recording medium.

The computer-readable recording medium includes a magnetic storage, such as a ROM, a floppy disk, or a hard disk, an optically readable medium, such as a CD-ROM or a DVD, and a carrier wave, such as transmission through the Internet.

According to the present invention, it is possible for a contents provider to perform a process of calculating a color temperature, which conventionally takes much effort and time, during preparing contents and to transmit a small amount of metadata with contents, i.e., image data. In addition, a contents client does not need to additionally calculate a color temperature, thus reducing the cost of manufacturing a display for the contents client. Accordingly, a user can adjust images using a portable terminal, even though the portable terminal is generally less effective than a TV set or a personal computer in terms of calculation. In addition, according to the present invention, it is possible to re-use the color temperatures of images, which are already computed, by storing them in a database for metadata 130. Accordingly, it is possible to more effectively display images on a user's terminal.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An apparatus for converting a metadata color temperature, comprising:

an input unit which receives an input image, metadata corresponding to the color temperature of the input image, and color temperature information preferred by a user;

an image metadata decoding unit which calculates a color temperature corresponding to the metadata; and an image color temperature converting unit which converts the color temperature of the input image using the color temperature calculated by the image metadata decoding unit and the color temperature information preferred by a user.

2. The apparatus of claim 1 further comprising an image display unit which outputs the input image, the color temperature of which is converted, and then provides the input image to a user.

3. The apparatus of claim 1, wherein the image metadata decoding unit calculates the color temperature of an image coded as metadata and decodes the metadata following the way the image is coded.

4. The apparatus of claim 1, wherein the image metadata decoding unit includes a predetermined look-up table, in which representative color temperatures of color temperatures ranges, which the color temperature belongs to, and their corresponding metadata are recorded, and finds a color temperature value corresponding to certain metadata by searching the metadata in the look-up table.

5. A method for converting the color temperature of metadata, comprising:

receiving a predetermined input image, metadata corresponding to the color temperature of the input image, and color temperature information preferred by a user;

calculating the color temperature corresponding to the metadata;

converting the color temperature of the input image using the color temperature calculated based on the metadata and the color temperature information preferred by a user, and outputting to a display device a modified image using the converted color temperature.

6. The method of claim 5 further comprising outputting the input image, the color temperature of which is converted, and providing the input image to a user.

7. A computer-readable recording medium, on which programs for realizing the method shown in claim 5 in a computer are recorded.

8. A method of generating descriptive data of an image, comprising:

(a) dividing color temperature sections into four perceptual color temperature browsing categories based upon perceptual feeling of illumination color, and generating 2 bits of descriptive data corresponding to the perceptual color temperature browsing category to which the color temperature of an image belongs;

(b) dividing each of the four perceptual color temperature browsing categories into 64 color temperature sub-regions, and generating 6 bits of descriptive data corresponding to the color temperature sub-region to which the color temperature of an image belongs, and storing 1 byte metadata comprising the generated 2 bits of descriptive data corresponding to the perceptual color temperature browsing category and the generated 6 bits of descriptive data corresponding to the color temperature sub-region on a tangible recording media.

9. A computer-readable recording medium, on which a program enabling the method of claim 8 is recorded.

10. A method of generating descriptive data of an image, comprising:

(a) dividing perceptual color temperature browsing categories into a hot temperature feeling browsing category, a warm temperature feeling browsing category, a moderate temperature feeling browsing category, and a cool temperature feeling browsing category, and generating 2 bits of descriptive data corresponding to the temperature feeling browsing category to which the color temperature of an image belongs; and (b) dividing each of the four perceptual color temperature browsing categories into 64 color temperature sub-regions, and generating 6 bits of descriptive data corresponding to the color temperature sub-region to which the color temperature of an image belongs, and storing 1 byte metadata comprising the generated 2 bits of descriptive data corresponding to the temperature feeling browsing category and the generated 6 bits of descriptive data corresponding to the color temperature sub-region on a tangible recording media.

11. A computer-readable recording medium, on which a program enabling the method of claim 10 is recorded.

12. A method for providing image metadata, comprising:

receiving a predetermined image signal and deriving color temperature information from the image signal by:

(a) dividing color temperature sections into four perceptual color temperature browsing categories based upon perceptual feeling of illumination color, and generating 2 bits of descriptive data corresponding to the perceptual color temperature browsing category to which the color temperature of an image belongs; and (b) dividing each of the four perceptual color temperature browsing categories into 64 color temperature sub-regions, and generating 6 bits of descriptive data corresponding to the color temperature sub-region to which the color temperature of an image belongs;

converting the color temperature information into metadata, and storing the metadata in a database; and transmitting the metadata as well as the image signal to a user terminal over a communication network in response to a request of the user terminal.

13. A computer-readable recording medium, on which a program enabling the method of claim 12 is recorded.

14. A method for providing image metadata, comprising:

receiving a predetermined image signal and deriving color temperature information from the image signal by:

(a) dividing perceptual color temperature browsing categories into a hot temperature feeling browsing category, a warm temperature feeling browsing category, a moderate temperature feeling browsing category, and a cool temperature feeling browsing category, and generating 2 bits of descriptive data corresponding to the temperature feeling browsing category to which the color temperature of an image belongs; and (b) dividing each of the four perceptual color temperature browsing categories into 64 color temperature sub-regions, and generating 6 bits of descriptive data corresponding to the color temperature sub-region to which the color temperature of an image belongs;

converting the color temperature information into metadata, and storing the metadata in a database, and transmitting the metadata as well as the image signal to a user terminal over a communication network in response to a request of the user terminal.

15. A computer-readable recording medium, on which a program enabling the method of claim 14 is recorded.

* * * * *